US010309229B2

(12) United States Patent
Reed et al.

(10) Patent No.: US 10,309,229 B2
(45) Date of Patent: Jun. 4, 2019

(54) NICKEL BASED ALLOY COMPOSITION

(71) Applicant: ROLLS-ROYCE PLC, London (GB)

(72) Inventors: Roger Reed, Stratford upon Avon (GB); David Crudden, Oxford (GB); Babak Raeisinia, Birmingham (GB); Mark Christopher Hardy, Derby (GB)

(73) Assignee: ROLLS-ROYCE PLC, London (GB)

( * ) Notice: Subject to any disclaimer, the term of this patent is extended or adjusted under 35 U.S.C. 154(b) by 1136 days.

(21) Appl. No.: 14/577,422

(22) Filed: Dec. 19, 2014

(65) Prior Publication Data

US 2015/0192022 A1 Jul. 9, 2015

(30) Foreign Application Priority Data

Jan. 9, 2014 (GB) ..... 1400352.9

(51) Int. Cl.
*C22C 19/05* (2006.01)
*F01D 5/28* (2006.01)
*C22C 30/00* (2006.01)

(52) U.S. Cl.
CPC ..... *F01D 5/28* (2013.01); *C22C 19/056* (2013.01); *C22C 30/00* (2013.01)

(58) Field of Classification Search
CPC ..... C22C 19/056; C22F 1/10
See application file for complete search history.

(56) References Cited

U.S. PATENT DOCUMENTS

| | | | |
|---|---|---|---|
| 2,948,606 | A | 8/1960 | Thielemann |
| 3,459,545 | A | 8/1969 | Bieber et al. |
| 3,677,747 | A | 7/1972 | Lund et al. |
| 4,161,412 | A | 7/1979 | Henry |
| 5,476,555 | A | 12/1995 | Erickson |
| 5,637,159 | A | 6/1997 | Erickson |
| 5,888,316 | A | 3/1999 | Erickson |
| 6,132,527 | A | 10/2000 | Hessell et al. |
| 6,468,368 | B1 | 10/2002 | Merrick et al. |
| 6,969,431 | B2 | 11/2005 | Hieber et al. |
| 6,974,508 | B1 | 12/2005 | Gabb et al. |
| 8,409,722 | B2 | 4/2013 | Torigoe et al. |
| 8,734,716 | B2 | 5/2014 | Harada et al. |
| 8,992,699 | B2 | 3/2015 | Bain et al. |
| 2003/0047251 | A1 | 3/2003 | Caron et al. |
| 2004/0221925 | A1 | 11/2004 | Tamaki et al. |
| 2004/0261921 | A1 | 12/2004 | Nazmy |
| 2005/0047954 | A1 | 3/2005 | Hieber et al. |
| 2006/0174482 | A1 | 8/2006 | Roedl et al. |
| 2007/0227630 | A1 | 10/2007 | Augustins Lecallier et al. |
| 2008/0026570 | A1 | 1/2008 | Kim et al. |
| 2008/0101981 | A1 | 5/2008 | Arrell et al. |
| 2010/0008778 | A1 | 1/2010 | Patrick et al. |
| 2010/0080729 | A1 | 4/2010 | Biondo et al. |
| 2010/0303665 | A1 | 12/2010 | Bain et al. |
| 2010/0329876 | A1 | 12/2010 | Bain et al. |
| 2011/0194971 | A1 | 8/2011 | Harada et al. |
| 2011/0203707 | A1 | 8/2011 | Mourer et al. |
| 2012/0269646 | A1 | 10/2012 | Mitchell et al. |
| 2012/0273093 | A1 | 11/2012 | Hanlon et al. |
| 2012/0279351 | A1 | 11/2012 | Gu et al. |
| 2013/0167687 | A1 | 7/2013 | Gu et al. |
| 2015/0192022 | A1 | 7/2015 | Reed et al. |

FOREIGN PATENT DOCUMENTS

| | | | | |
|---|---|---|---|---|
| EP | 1193321 | A1 | 4/2002 | |
| EP | 1195446 | A1 | 4/2002 | |
| EP | 1201777 | A1 | 5/2002 | |
| EP | 2256223 | A1 | 12/2010 | |
| EP | 2281907 | A1 | 2/2011 | |
| EP | 2407565 | A1 | 1/2012 | |
| EP | 3042973 | A1 | 7/2016 | |
| GB | 990022 | A | 4/1965 | |
| GB | 2152076 | A | 7/1985 | |
| JP | 2000063969 | A | 2/2000 | |
| SU | 426537 | C * | 12/1976 | ..... C22C 19/056 |
| WO | 2012/047352 | A2 | 4/2012 | |
| WO | 2014/157144 | A1 | 10/2014 | |

OTHER PUBLICATIONS

Nov. 17, 2016 Search Report issued in European Patent Application No. 16177287.6.
Jul. 1, 2014 Search Report issued in British Patent Application No. GB 1400352.9.
May 22, 2015 Search Report issued in European Patent Application No. 14198811.
U.S. Appl. No. 14/966,564, filed Dec. 11, 2015 in the name of Mark C. Hardy.
Apr. 15, 2016 Search Report issued in British Patent Application No. 1511684.1.
Jan. 2, 2018 Office Action issued in U.S. Appl. No. 15/200,779.
U.S. Appl. No. 15/200,779, filed Jul. 1, 2016 in the name of Mark Hardy.
Sep. 18, 2015 Search Report issued in British Patent Application No. 1500177.9.
Mignanelli et al., "The influence of Al:Nb ratio on the microstructure and mechanical response of quaternary Ni—Cr—Al—Nb alloys," Materials Science & Engineering A, vol. 612, 2014, pp. 179-186.
Stephens et al., "Understanding the Roles of the Strategic Element Cobalt in Nickel Base Superalloys," Prepared for the Materials Substitution and Recycling Meeting, Vimerio, Portugal, Oct. 10-14, 1983, NASA Tech. Memo. 83475.

(Continued)

*Primary Examiner* — Jessee R Roe
(74) *Attorney, Agent, or Firm* — Oliff PLC

(57) ABSTRACT

A nickel based alloy composition including, by atomic per cent, between 12 and 15% of elements from the group of aluminium, titanium, tantalum and niobium, between 0.8 and 1.8% tungsten, between 5 and 8% aluminium, at least 28% of elements from the group of molybdenum, tungsten, chromium and cobalt, wherein the atomic ratio of the sum of titanium, tantalum and niobium to aluminium is between 0.6 and 1.1, and wherein the composition includes less than 1.5% molybdenum, the balance being nickel save for incidental impurities.

14 Claims, 12 Drawing Sheets

(56) References Cited

OTHER PUBLICATIONS

Jun. 19, 2018 Office Action issued in U.S. Appl. No. 15/200,779.
Apr. 27, 2018 Office Action issued in U.S. Appl. No. 14/966,564.
Nov. 19, 2018 Office Action Issued in U.S. Appl. No. 15/200,779.
Dec. 5, 2018 Office Action issued in U.S. Appl. No. 15/946,170.

* cited by examiner

Table 1
Element Concentration Weight Percent (wt%)

| Alloy | Cr | Co | Fe | Mo | Al | Ti | Ta | W | Nb | Hf | Zr | B | C | Ni |
|---|---|---|---|---|---|---|---|---|---|---|---|---|---|---|
| Inconel 718 | 19.00 | 0.50 | 18.00 | 2.90 | 0.45 | 1.00 | 0.00 | 0.00 | 5.40 | 0.00 | 0.05 | 0.000 | 0.030 | Bal |
| Udimet 720Li | 16.00 | 15.00 | 0.00 | 3.00 | 2.50 | 5.00 | 0.00 | 1.25 | 0.00 | 0.00 | 0.035 | 0.020 | 0.020 | Bal |
| RR1000 | 15.00 | 18.50 | 0.00 | 5.00 | 3.00 | 3.60 | 2.00 | 0.00 | 0.00 | 0.50 | 0.06 | 0.030 | 0.030 | Bal |
| ME3 | 13.00 | 20.50 | 0.00 | 3.70 | 3.40 | 3.60 | 2.40 | 2.00 | 0.90 | 0.00 | 0.05 | 0.030 | 0.040 | Bal |
| LSHR | 13.00 | 21.00 | 0.00 | 2.70 | 3.50 | 3.50 | 1.60 | 4.30 | 1.50 | 0.00 | 0.05 | 0.030 | 0.030 | Bal |
| Alloy 10 | 11.00 | 18.50 | 0.00 | 2.60 | 3.55 | 3.75 | 1.50 | 4.60 | 1.00 | 0.00 | 0.075 | 0.030 | 0.030 | Bal |
| Maurer et al | 14-18 | 3-7 | <2 | 0.3-3.0 | 3.5-5.5 | 1-4 | <0.05 | 4-8 | <0.05 | 0 | <0.1 | <0.1 | 0.05 | Bal |
| Allvac 718 Plus | 19.0 | 9.0 | 10.0 | 2.8 | 1.5 | 0.7 | 0.0 | 1.0 | 5.5 | 0.0 | 0.000 | 0.010 | 0.030 | Bal |

Figure 9

Table 2

| | Cr | Co | W | Al | Ti | Ta | Nb | C | B | Zr | Hf | Mo |
|---|---|---|---|---|---|---|---|---|---|---|---|---|
| **Element Concentration (wt%)** | | | | | | | | | | | | |
| **Upper** | 14.9 | 19.4 | 5.2 | 4.3 | 5.5 | 3.5 | 3.4 | 0.05 | 0.44 | 0.1 | 1.5 | 1.5 |
| **Lower** | 10.7 | 15 | 2.7 | 2.4 | 2.1 | 1.5 | 0 | 0.01 | 0.01 | 0.03 | 0 | 0 |
| **Element Concentration (at%)** | | | | | | | | | | | | |
| **Upper** | 17.3 | 18.3 | 1.8 | 8.2 | 6.2 | 1.2 | 2.1 | 0.30 | 0.25 | 0.06 | 0.5 | 1.0 |
| **Lower** | 12 | 14 | 0.8 | 5.8 | 2.7 | 0.4 | 0 | 0.05 | 0.05 | 0.02 | 0 | 0 |

Figure 10

Table 3

| Material Property | Target | Compositional Restrictions |
|---|---|---|
| **Specific Yield Strength** | 10% increase | Al+Ti+Ta+Nb ≥ 12 at%<br>(Ti+Ta+Nb)/Al ≥ 0.6 (at%) |
| **Creep Merit Index** | Equivalent or Better | Cr+Co+Mo+W ≥ 28 at% |
| **Material Costs** | No more than 15% increase | Ta ≤ 1.2 at% |
| **γ' solvus Temperature** | Less than 1200°C | Al ≤ 8 at% |
| **Free from deleterious phases (e.g. σ, η, δ)** | | Mo < 1 at%<br>Al+Ti+Ta+Nb ≤ 15 at%<br>Cr+Co+Mo+W ≤ 35 at%<br>Md γ ≤ 0.88<br>(Ti+Ta+Nb)/Al ≤ 1.1<br>Nb ≤ 2at% |
| **Oxidation Resistant** | Equivalent or Better | Cr ≥ 12 at%<br>Cr/Ti (at%) ≥ 3 |

Figure 11

Table 4

| Alloy | Cr | Co | W | Al | Ti | Ta | Nb | C | B | Zr |
|---|---|---|---|---|---|---|---|---|---|---|
| **Element Concentration (wt%)** | | | | | | | | | | |
| T1 | 20.25 | 19.00 | 1.00 | 3.94 | 3.45 | 2.00 | 0.00 | 0.027 | 0.015 | 0.060 |
| T2 | 17.25 | 19.00 | 3.00 | 3.81 | 3.45 | 2.00 | 0.00 | 0.027 | 0.015 | 0.060 |
| T3 | 15.25 | 19.00 | 5.00 | 3.69 | 3.45 | 2.00 | 0.00 | 0.027 | 0.015 | 0.060 |
| T4 | 17.19 | 19.00 | 3.00 | 3.80 | 3.09 | 2.00 | 0.67 | 0.027 | 0.015 | 0.060 |
| T5 | 17.14 | 19.00 | 3.00 | 3.79 | 2.74 | 2.00 | 1.33 | 0.027 | 0.015 | 0.060 |
| T6 | 17.08 | 19.00 | 3.00 | 3.77 | 2.39 | 2.00 | 1.99 | 0.027 | 0.015 | 0.060 |
| **Element Concentration (at%)** | | | | | | | | | | |
| T1 | 19.43 | 18.23 | 0.31 | 8.22 | 4.06 | 0.62 | 0.00 | 0.127 | 0.078 | 0.037 |
| T2 | 18.69 | 18.17 | 0.92 | 7.96 | 4.06 | 0.62 | 0.00 | 0.127 | 0.078 | 0.037 |
| T3 | 16.81 | 18.48 | 1.56 | 7.84 | 4.13 | 0.63 | 0.00 | 0.129 | 0.080 | 0.038 |
| T4 | 18.69 | 18.17 | 0.92 | 7.96 | 3.65 | 0.62 | 0.41 | 0.127 | 0.078 | 0.037 |
| T5 | 18.69 | 18.17 | 0.92 | 7.97 | 3.25 | 0.62 | 0.81 | 0.127 | 0.079 | 0.037 |
| T6 | 18.69 | 18.17 | 0.92 | 7.95 | 2.84 | 0.62 | 1.22 | 0.128 | 0.079 | 0.037 |

Figure 12

Table 5

| | Cr | Co | Al | Ti | Ta | Mo | W | Nb | B | C | Zr |
|---|---|---|---|---|---|---|---|---|---|---|---|
| | Element Concentration (wt%) | | | | | | | | | | |
| D1 | 13.6 | 16.5 | 3.3 | 3.1 | 1.6 | 0.0 | 3.2 | 2.1 | 0.015 | 0.027 | 0.059 |
| D2 | 14.7 | 14.6 | 3.8 | 3.4 | 1.6 | 0.0 | 2.6 | 1.6 | 0.015 | 0.027 | 0.060 |
| D3 | 10.7 | 17.2 | 3.7 | 3.3 | 3.1 | 0.0 | 4.7 | 1.6 | 0.015 | 0.026 | 0.058 |
| D4 | 14.3 | 16.2 | 2.8 | 2.5 | 3.1 | 0.0 | 2.5 | 3.2 | 0.015 | 0.026 | 0.058 |
| D5 | 14.6 | 14.5 | 2.8 | 4.6 | 1.6 | 0.0 | 3.2 | 0.8 | 0.015 | 0.027 | 0.059 |
| D6 | 12.4 | 14.1 | 3.4 | 2.7 | 3.7 | 1.4 | 4.4 | 1.4 | 0.025 | 0.050 | 0.056 |
| | Element Concentration (at%) | | | | | | | | | | |
| D1 | 15 | 16 | 7 | 3.7 | 0.5 | 0 | 1 | 1.3 | 0.079 | 0.127 | 0.037 |
| D2 | 16 | 14 | 8 | 3.7 | 0.5 | 0 | 0.8 | 1.3 | 0.079 | 0.127 | 0.037 |
| D3 | 12 | 17 | 8 | 4 | 1 | 0 | 1.5 | 1 | 0.079 | 0.127 | 0.037 |
| D4 | 16 | 16 | 6 | 3 | 1 | 0 | 0.8 | 2 | 0.079 | 0.127 | 0.037 |
| D5 | 16 | 14 | 6 | 5.5 | 0.5 | 0 | 1 | 0.5 | 0.079 | 0.127 | 0.037 |
| D6 | 14 | 14 | 7.4 | 3.25 | 1.2 | 0.85 | 1.4 | 0.9 | 0.135 | 0.245 | 0.036 |

Figure 13

NICKEL BASED ALLOY COMPOSITION

FIELD OF THE INVENTION

The present invention relates to a nickel based alloy composition, as well as a method of forming an article from a nickel based alloy, a heat treatment method for producing forgings of a nickel based alloy, a turbine disc comprising a nickel based alloy, and a gas turbine engine comprising a turbine disc.

BACKGROUND TO THE INVENTION

Table 1 defines prior nickel based compositions suitable for use in rotor discs for gas turbine engines, such as high pressure compressor and turbine discs. These include the following compositions described in the corresponding documents: Udimet™ 720Li (described in U.S. Pat. No. 4,093,476); RR1000™ (described in U.S. Pat. No. 6,132,527); ME3, also known as René 104™ (described in U.S. Pat. No. 6,521,175); LSHR (described in U.S. Pat. No. 6,974,508); Alloy 10 (described in U.S. Pat. No. 6,468,368); Maurer et al (described in U.S. Pat. No. 4,629,521) and Allvac 718 Plus™ (described in U.S. Pat. No. 6,730,264).

Nickel based alloys for use in gas turbine engine components such as high pressure rotor discs have a number of requirements. They must be resistant to environmental degradation such as hot corrosion and oxidation, have a high yield strength at high temperatures, be resistant to creep strain accumulation and dwell fatigue, have a low density, and a good surface stability. In the art, the "stability" of an alloy is normally understood to refer to the alloy's propensity to precipitate detrimental phases (i.e. an alloy having a high stability will have a low propensity to precipitate detrimental phases). An example of a detrimental phase is the sigma (σ) phase, which can occur when the alloy is subjected to high temperatures for extended time periods (known as "dwell"). One aim of the invention is therefore to minimise the volume fraction of the σ phase after a given time at a given anticipated operating temperature (generally between around 700° C. and 800° C.).

It is also desirable for the alloy composition to have a low cost, and be suitable for low cost production methods such as forging and powder metallurgy. Alloys having the above properties, and therefore being suitable for use in gas turbine engine components such as turbine blades and rotors discs, are generally known in the art as "superalloys", and are sometimes also referred to as "high performance alloys".

Of these above requirements, the yield strength of the composition at high temperatures (i.e. between around 700 to 800° C.) is considered to be most important. The prior nickel based alloys listed in Table 1 have an operational temperature range between 700 and 750° C. Above this temperature, the yield strength of these alloys has been found to be insufficient for some applications, such as for rotor discs in gas turbine engines.

Increasingly, nickel based alloys used for disc rotor applications in modern gas turbine engines for civil aircraft are expected to operate for longer periods of time at temperatures above 700° C., and in some cases up to 800° C. Rotor discs capable of operating at these temperatures are desirable in order to increase compressor discharge temperatures and rotational speeds, particularly for high pressure compressor and turbine rotors, as both of these factors will lead to increased turbine inlet temperatures, and therefore improved overall thermal and fuel efficiency of the gas turbine engine employing these discs.

FIG. 2 shows a cross sectional side view of part of a typical rotor disc 40 having an attached blade 41. The disc 40 comprises a radially outer rim 42, and diaphragm 44 extending from an inner annulus 45 (also known as a bore) of the disc 40 to the rim 42.

Both the rim 42 and diaphragm 44 of disc rotors 40 can be exposed in use to dwell or sustained load-fatigue cycles at these high temperatures. Under these conditions, stress-assisted oxidation and time dependent deformation can produce intergranular crack growth and therefore high rates of crack growth in discs made of prior alloys. Similar discs 40 are used for both the compressor and turbine sections of the engine. As a result, resistance to dwell crack growth, and damage tolerance, is a priority for new superalloys for turbine discs. Secondly, many of the prior alloys described in Table 1 have compromised resistance to surface degradation caused by environmental conditions (such as oxidation and type II hot corrosion damage) for improved high temperature strength, resistance to creep strain accumulation and for stable bulk material microstructures (to prevent the precipitation of detrimental topological close packed (TCP) phases). As discs are being exposed to increasingly high temperatures, exceeding 700° C., oxidation and hot corrosion damage has become a significant limiting factor for component life. There is now a need to prioritise resistance to hot corrosion and oxidation damage, ahead of other properties when defining alloy chemistries, while maintaining sufficient yield strength at these high temperatures, at an acceptable cost. If prior alloys are used at such high temperatures, environmental protection will need to be applied to disc rotors (e.g. surface coatings), which is technically very difficult and undesirable due to the increased weight and complexity of such discs and the additional manufacturing steps required to form such discs.

The present invention seeks to provide an improved alloy composition, an improved rotor disc, an improved gas turbine engine, and an improved method of forming an article which solves some or all of the above problems.

SUMMARY OF THE INVENTION

According to a first aspect of the present invention there is provided a nickel based alloy consisting essentially of, in atomic percent, between 12 and 17.3% chromium, between 13.7 and 18.3% cobalt, between 0.8 and 1.8% tungsten, between 5.8 and 8.2% aluminium, between 2.7 and 6.2% titanium, between 0.4 and 1.7% tantalum, up to 2.1% niobium, between 0.05 and 0.3% carbon, between 0.05% and 0.25% boron, between 0.02 and 0.06 zirconium, up to 1.5% molybdenum, up to 0.2% hafnium, up to 4% iron, up to 1% silicon and up to 0.65% manganese the balance being nickel save for incidental impurities.

It has been found that the nickel based alloy composition of the present invention has a high strength at temperatures above around 800° C., and is also relatively lightweight, resistant to environmental degradation, inexpensive and suitable for conventional forming and machining processes. These properties make the alloy particularly suitable for use in the manufacture of rotor discs for gas turbine engines.

According to a second aspect of the invention, there is provided a rotor disk for a gas turbine engine formed of an alloy in accordance with the first aspect of the invention.

The alloy of the first aspect of the invention has been found to be particularly suitable for forming rotor disks for gas turbine engines, as the alloy has suitable properties for such use. In particular, rotor disks comprising from the alloy have been found to have a yield strength greater than 1000

MPa at a temperature of approximately 800° C., while having the required low weight, high corrosion resistance and acceptable cost. The composition has also been found to be amenable to conventional manufacturing and forming methods, without the requirement for additional surface treatments.

According to a third aspect of the invention there is provided a gas turbine engine comprising a rotor disk according to the second aspect of the invention.

Accordingly, the invention provides a gas turbine engine having one or more rotors having a high yield strength at high temperatures. Consequently, the gas turbine engine can operate at a higher thermal efficiency, and hence lower specific fuel consumption, or may have a longer service life between overhauls, resulting in a lower operating cost.

According to a fourth aspect of the invention there is provided a method of forming an article, comprising providing an alloy powder having a composition according to the first aspect of the invention, and consolidating the powder under isostatic conditions.

The alloy of the present invention has been found to be suitable to relatively low cost manufacturing techniques, such as isostatic pressing. Isostatic pressing can be used to form near net shape components, resulting in low processing time and waste, and hence a low "buy to fly" ratio. Consequently, the method provides a relatively inexpensive method for producing gas turbine rotor discs.

Further features of the invention are described in the attached claims.

BRIEF DESCRIPTION OF THE DRAWINGS

Embodiments of the invention are described and shown in the following drawings, in which:

FIG. 9 is an illustration of Table 1, which describes prior nickel based alloys and their elemental compositions;

FIG. 10 is an illustration of Table 2, which describes the ranges of elemental compositions in terms of atomic per cent and weight per cent of a nickel based alloy in accordance with the present invention;

FIG. 11 is an illustration of Table 3, which describes property restraints and associated compositional restraints required on alloy chemistry, where RR1000, described in Table 1 is the benchmark condition;

FIG. 12 is an illustration of Table 4, which describes example compositions T1 to T6 in accordance with the present invention; and FIG. 13 is an illustration of Table 5, which describes preferred example compositions D1 to D10 in accordance with the present invention.

DETAILED DESCRIPTION OF THE INVENTION

Figure 1:
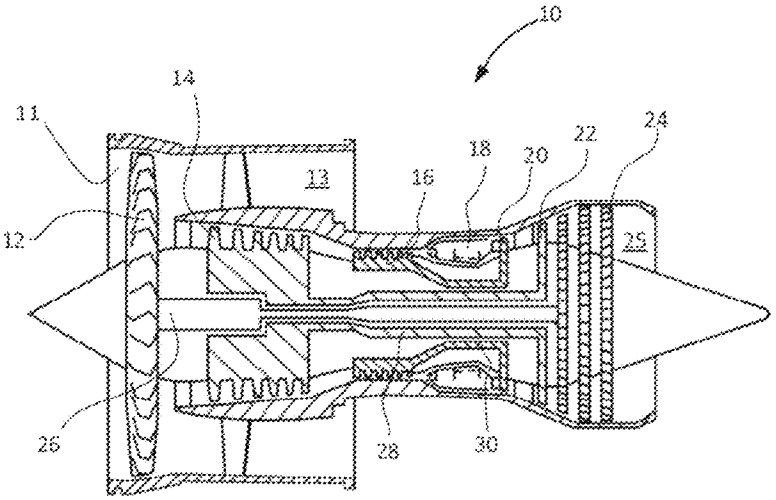
FIG. 1 shows a cross sectional view of a gas turbine engine.

FIG. 1 shows a gas turbine engine 10. The engine 10 comprises, in axial flow series, an air intake duct 11, an intake fan 12, a bypass duct 13, an intermediate pressure compressor 14, a high pressure compressor 16, a combustor 18, a high pressure turbine 20, an intermediate pressure turbine 22, a low pressure turbine 24 and an exhaust nozzle 25. The fan 12, compressors 14, 16 and turbines 20, 22, 24 all rotate about the major axis of the gas turbine engine 10 and so define the axial direction of gas turbine engine.

Air is drawn through the air intake duct 11 by the intake fan 12 where it is accelerated. A significant portion of the airflow is discharged through the bypass duct 13 generating a corresponding portion of the engine 10 thrust. The remainder is drawn through the intermediate pressure compressor 14 into what is termed the core of the engine 10 where the air is compressed. A further stage of compression takes place in the high pressure compressor 16 before the air is mixed with fuel and burned in the combustor 18. The resulting hot working fluid is discharged through the high pressure turbine 20, the intermediate pressure turbine 22 and the low pressure turbine 24 in series where work is extracted from the working fluid. The work extracted drives the intake fan 12, the intermediate pressure compressor 14 and the high pressure compressor 16 via shafts 26, 28, 30. The working fluid, which has reduced in pressure and temperature, is then expelled through the exhaust nozzle 25 and generates the remaining portion of the engine 10 thrust.

Figure 2:
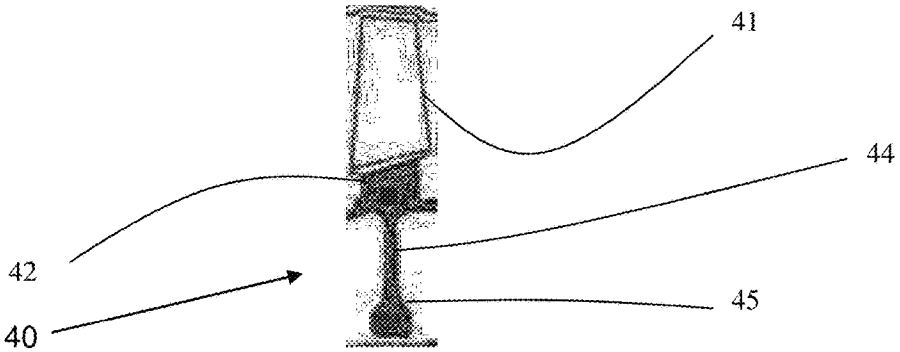
FIG. 2 shows a cross sectional view of part of a rotor disc of the engine of FIG. 1.

FIG. 2 shows a rotor disc 40 for one of the compressors 14, 16 or turbines 20, 22, 24 of the gas turbine engine 10. The disc 40 comprises a radially outer rim 42, and a diaphragm 44 extending from a bore 45 of the disc 40 to the rim 42. A blade in the form of a compressor blade 41 is attached to the outer rim 42 of the disc, and is generally formed of a different material to the disc 40. The disc 40 comprises a nickel based superalloy composition in accordance with the present invention, and is formed by a powder metallurgy process followed by a forging process. Though a compressor blade 41 is attached to the disc shown in the FIG. 2, the disc 40 may also be suitable for attachment of a turbine blade.

Table 2 describes a compositional range for a nickel based alloy in accordance with the invention. In conjunction with the specific ranges selected for each alloying element, particular combinations/ratios of alloying elements necessary to produce a high performance disc rotor alloy have been identified. The required performance parameters, and the resultant ratios for the newly developed disc rotor alloy are summarised in Table 3.

The nickel based superalloy composition comprises nickel, which forms a continuous matrix comprising a face centered cubic (FCC) nickel based austenitic phase containing solid solution elements. The nickel based continuous matrix is known within the art as the "gamma (γ)" phase. Some of these alloying elements form a primary strengthening phase known as a "gamma prime (γ')" phase in an amount such that the volume fraction of the γ' is between 50% and 60%. The γ' phase has the general formula $Ni_3x$, where x comprises elements selected from titanium (Ti), aluminium (Al), tantalum (Ta) and niobium (Nb), and usually comprises an ordered intermetallic $L_{12}$ crystal structure. Formation of the γ' phase occurs in the solid state as the supersaturated solid solution of γ-nickel is cooled below its solvus temperature.

Figure 3:
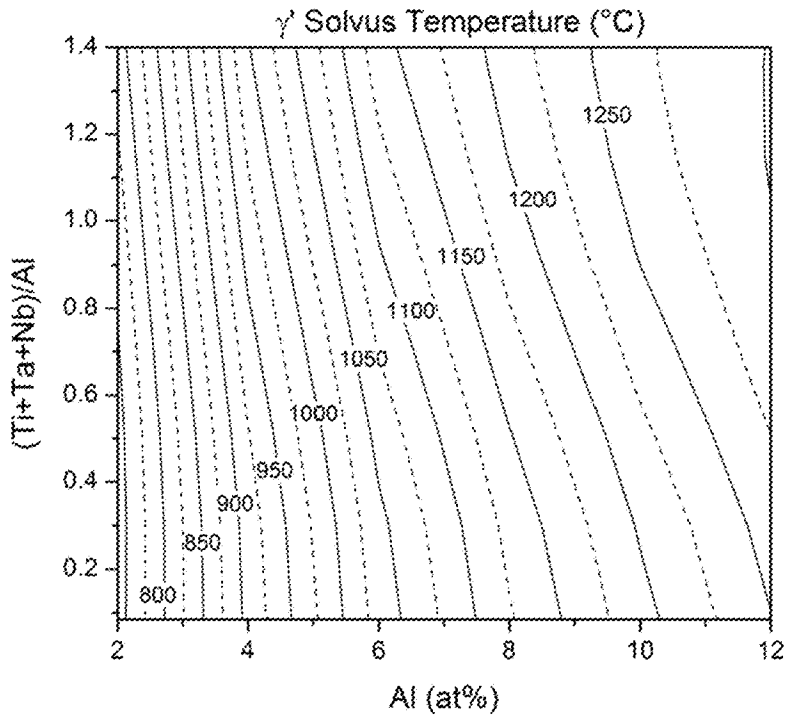
FIG. 3 shows the compositional-property relationship for γ' solvus temperature.

The γ' solvus temperature limits the maximum allowable concentration of Al in the alloy. Excessively high γ' solvus temperatures complicate the processing of nickel based alloys for rotor disc applications, increasing the likelihood of quench cracking during the cooling phase of heat treatments conducted above the γ' solvus temperature. It has been reported that alloys with a γ' solvus temperature below 1180° C. are less susceptible to quench cracking. Modelling work using phase equilibrium calculations—shows a strong correlation between the maximum Al concentration in the alloy and increasing γ' solvus temperature, FIG. 3. The (Ti+Ta+Nb)/Al ratio also had the effect of increasing the γ' solvus temperature, however, this effect was much less pronounced. It was determined that the Al level should be restricted to at most 8 at % to maintain a γ' solvus temperature below 1,200° C. and preferably below 1,180° C. in the newly developed alloy. Additions of up to 1 at % silicon (Si) may also be incorporated to lower the γ' solvus temperature.

Figure 4:
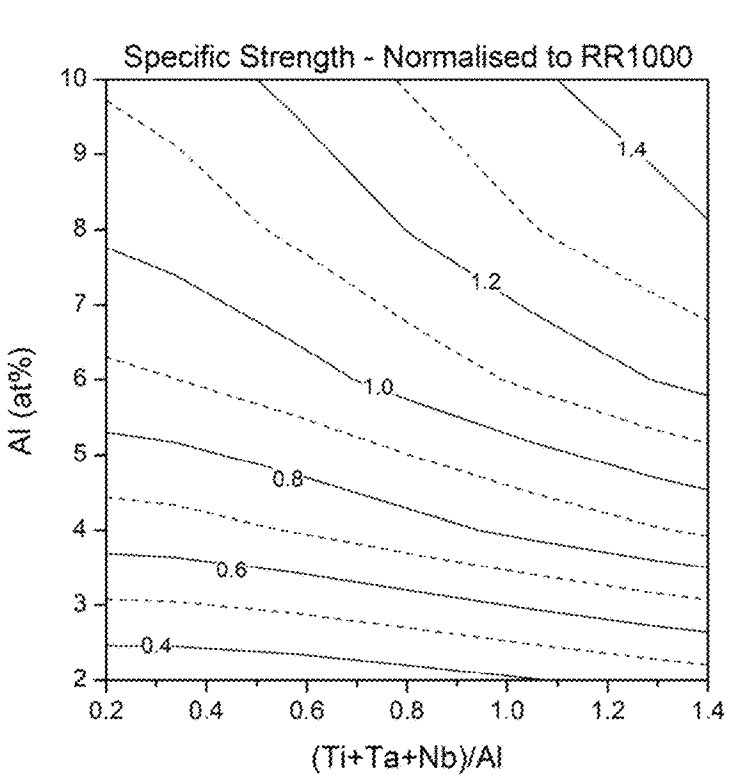
FIG. 4 shows the compositional-property relationship for specific yield strength—contours represent the specific yield strength normalised to calculated specific yield strength for RR1000.

Based on hardening theory the specific yield strength was determined using the following equation:

$$\sigma_{ys} = \frac{\overline{M}}{2}\frac{\gamma_{APB} f^{1/2}}{\rho}$$

where $\sigma_{ys}$ is the specific yield strength and $\overline{M}$ is the taylor factor, f is the volume fraction of γ', $\gamma_{APB}$ is the anti-phase boundary (APB) energy and ρ is the density. The APB energy (in $mJ/m^2$) was calculated using the following equation, $$\gamma_{APB}=195-1.7x_{Cr}-1.7x_{Mo}+4.6x_{W}+27.1x_{Ta}+21.4x_{Nb}+15x_{Ti}$$

where, $x_{Cr}$, $x_{Mo}$, $x_{W}$, $x_{Ta}$, $x_{Nb}$ and $x_{Ti}$ is the atomic percentage of chromium (Cr), molybdenum (Mo), tungsten (W), Ta, Nb and Ti in the γ' phase. Calculation of the specific yield strength produces a composition-property relationship outlined in FIG. 4.

Although the use of Ta and Nb was seen to be advantageous when designing an alloy with increased specific yield strength, the maximum allowable concentration for each of these alloying elements was limited by cost (particularly in the case of Ta) and microstructural stability (for Nb). It was determined from phase equilibrium calculations that Nb additions must remain below 2 at % to avoid precipitation of the δ phase. Additions of Ta were found to significantly influence the raw material cost for the alloy. Consequently, it was concluded that the Ta level must be limited to at most 1.7 at % to limit the increase in material cost to within 20% of the current state of the art (RR1000).

Experiments on alloys T1-T3 listed in Table 4 show that a minimum of 50% γ' volume fraction is necessary for adequate yield strength at 800° C.—this strength increase was attributed to the higher volume fraction of γ' in the alloy at 800° C. It was also observed that W played an important role in increasing the yield strength, with modifications from 0.3 at % to 1.6 at % increasing the yield strength by approximately 70 MPa. From these experiments a number of conclusions essential to selecting the final alloy composition could be made:

1. (Ti+Ta+Nb)/Al should be greater than 0.6, preferably greater than 0.78, in order produce a γ' phase with APB energy sufficiently high enough to increase tensile strength;
2. Volume fraction of γ' must be greater than 50% in order to produce alloys with an operational temperature up to 800° C.; and
3. W levels should be greater than or equal to 0.8 at % for suitable tensile strength at 800° C.

Figure 6A:
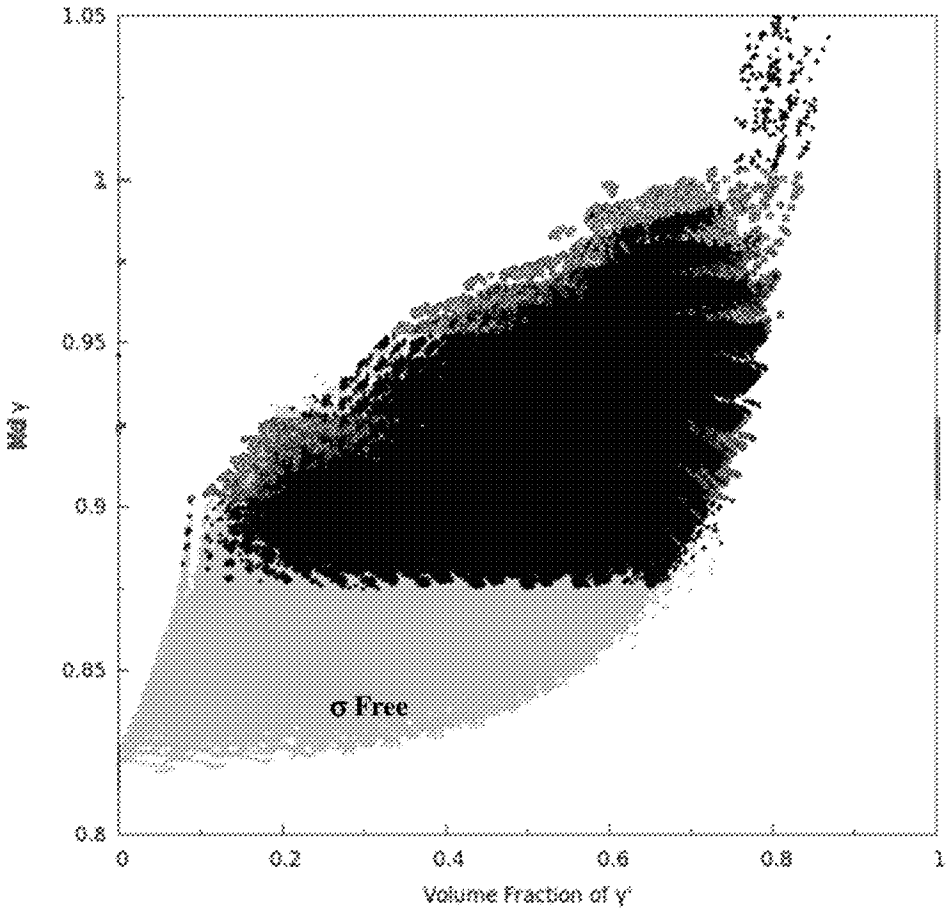
FIGS. 6(*a*) and 6(*b*) show the correlation between $Md_\gamma$ and volume fraction of γ' for the alloy design space, where (a) Cr≥12 at %, (b) Cr>16 at %—grey data points denote alloys which are free from σ phase and black data points represent alloys which contain the σ phase.
Figure 6B:
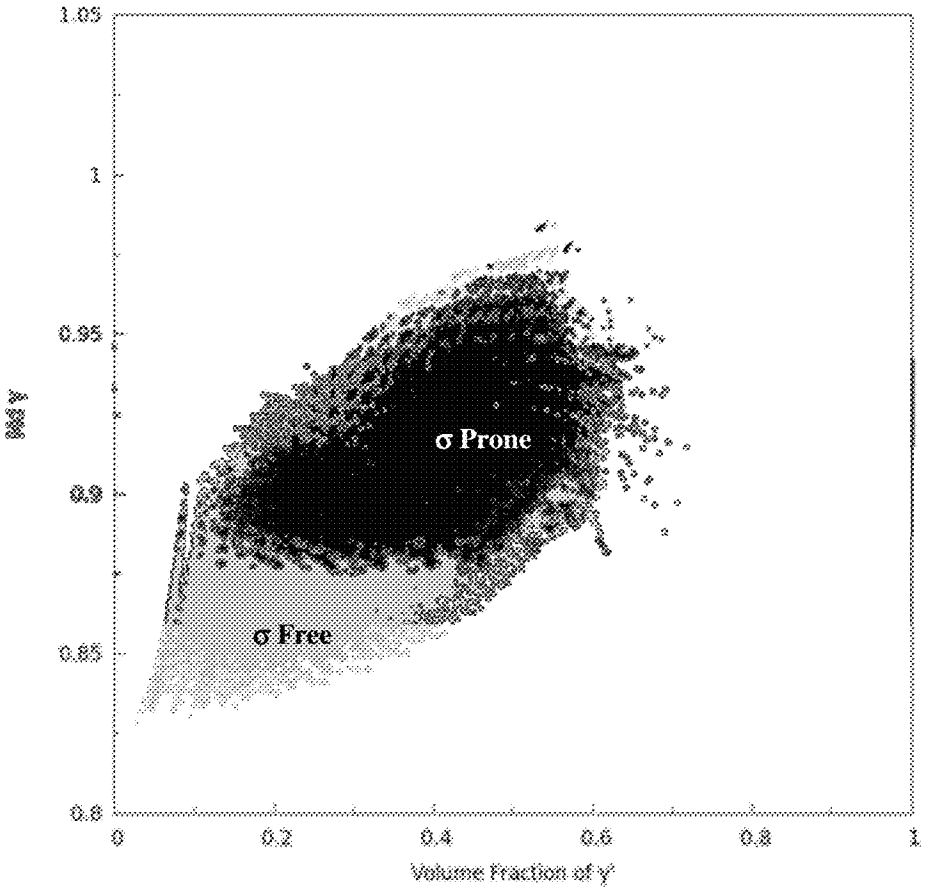

In conjunction with increasing the specific yield strength of the newly designed alloy there was the requirement to improve creep and corrosion resistance, particularly as these damage mechanisms are accelerated by increased temperature. The effect additions of Cr, Co, Mo and W—which partition to the γ phase—have on creep and corrosion resistance was considered as part of the design process. Microstructural stability restricted the maximum concentration of these alloying elements. The microstructural stability of the alloy, defined by the propensity to form deleterious topologically close packed (TCP) phases such as σ, was considered using 2 methods, phase equilibrium calculations (5 phase equilibrium considered (γ/γ'/σ/δ/η)) and calculation of the metal-d levels for the γ phase, $Md_\gamma$. For the composition range defined in Table 2 good correlation between both these methods was observed, see FIGS. 6*a*-6*b*. By examining the results from both these calculations it was concluded that the maximum allowable value for $Md_\gamma$ was approximately 0.88, where $Md_\gamma$ can be calculated in accordance with the following equation:

$$Md_\gamma = \sum_{i=1}^{n} x_i (Md)_i$$

Where $x_i$ is the atomic fraction of element i in the γ matrix, $Md_i$ is the parameter representing an average energy level of d orbitals of the alloying element i, and n is the number of elements in the γ matrix.

Additions of Cr, Co, Mo and W increase the value of $Md_\gamma$. Additions of these elements improves both creep and corrosion resistance whilst reducing microstructural stability in the alloy. The alloys, T1-T6 described in Table 4—with $Md_\gamma$ values ranging between 0.91-0.93—validated these modelling predictions, as microstructural instability was observed experimentally.

An evident trade-off between the minimum requirements for corrosion resistance, creep resistance, and specific yield strength was apparent. The alloy of the present invention however delivers all the material property requirements desired. The alloys described within this disclosure resists corrosion—considered to be predominantly from oxidation damage—by forming a continuous layer of protective chromia ($Cr_2O_3$) scale at the interface between the material and the surrounding environment. To examine the effect of alloy chemistry on oxidation resistance a series of oxidation experiments were conducted on a number of chromia forming nickel based superalloys. The results showed that the minimum Cr content required to produce a protective scale was 12 at %, FIG. 5. Creep resistance was considered using the creep merit index. The creep merit index, $M_{creep}$, is calculated as a function of the atomic fraction of each alloying element $x_i$ and the inter-diffusion coefficient of that alloy $D_i$:

$$M_{creep} = \sum_i \frac{x_i}{D_i}$$

The inter-diffusional coefficient $D_i$ is calculated by ($D_i = D_{0i} \exp\{-Q/RT\}$) where, $D_{0i}$ is a pre-exponential term, $Q_i$ is the activation energy for diffusion, R is the universal gas constant and T is the absolute temperature.

It was calculated that the sum of the forming elements Cr, Co, Mo and W must be at least 28 at % in order to achieve adequate creep resistance.

The combination of minimum requirements for specific yield strength, corrosion resistance and creep resistance resulted in the discovery of an optimal range for γ' volume fraction.

The criterion necessary to deliver optimal alloy performance are given in Table 3. From these requirements it was determined that the volume fraction of γ' must be greater than or equal to 50% and less than 60%. From phase equilibrium calculations it was determined that the sum of Al+Ti+Ta+Nb must be at least equal to 12 at % and no greater than 15 at % in order to produce the desired volume fraction of γ'. Furthermore, with the Al content fixed between 5 and 8 at %, it is necessary that the ratio of (Ti+Ta+Nb)/Al must be greater than 0.6 but must not exceed 1.1. Given these requirements, it is necessary that the sum of Ti+Ta+Nb must be greater than 5 at % and less than equal to 7.5 at %. Therefore, the minimum allowable concentration of Ti must be equal to 2 at % and the maximum allowable Ti concentration must be equal to 6 at %. It has been determined by the inventors that the newly developed alloy should be substantially free from additions of Mo. Currently there are no Mo free rotor disc alloys commercially produced. The present invention therefore represents a significantly innovative step. Excluding or greatly reducing Mo content enabled the creep resistance (measured in terms of the creep merit index) and corrosion resistance (in terms of the Cr content) to be maximised for a microstructurally stable alloy (i.e $Md_\gamma$ was less than or equal to 0.88). Typically, Mo and W are added for creep resistance (see the prior alloys listed in Table 1). These elements have a similar value for Md. However, W has a much stronger effect on creep resistance; therefore lower concentrations of W are needed to obtain adequate creep resistance. Using W in preference to Mo allows for increased levels of Cr in a high strength, creep resistant nickel based alloy that is microstructurally stable.

To meet the minimum requirement for creep resistance, it has been determined that the sum of Cr, Co, Mo and W must be greater than 28 at %. However, for optimal creep strength it was calculated that the sum of Cr, Co Mo and W must be between 33 and 35 at %. The upper limit for Cr, Co, Mo and W was determined to be 35 at % to produce a microstructurally stable alloy that met the minimum specific yield strength and oxidation resistance requirements. To enable optimal creep resistance it was determined that the Co levels must be between 14 and 18 at %. Experimental work on alloys T1, T2 and T3, defined in Table 4, identified that additions of W had a strong influence on creep resistance, increases from 0.31 at % to 1.56 at % improved creep resistance by 1 LMP (Larson Miller Parameter). For this reason a minimum W content of 0.8 at % was selected, the W content was limited to 1.8 at % due to the significant increases to density produced by higher W content.

In order to achieve exceptional oxidation resistance, experimental results showed high concentrations of Cr were required. Given that the minimum requirement for specific strength dictates that at least 50% volume fraction of γ' is required, it has been found that the maximum allowable Cr concentration for a microstructurally stable alloy is 16 at %, as demonstrated by FIG. 6*a*.

Figure 7:
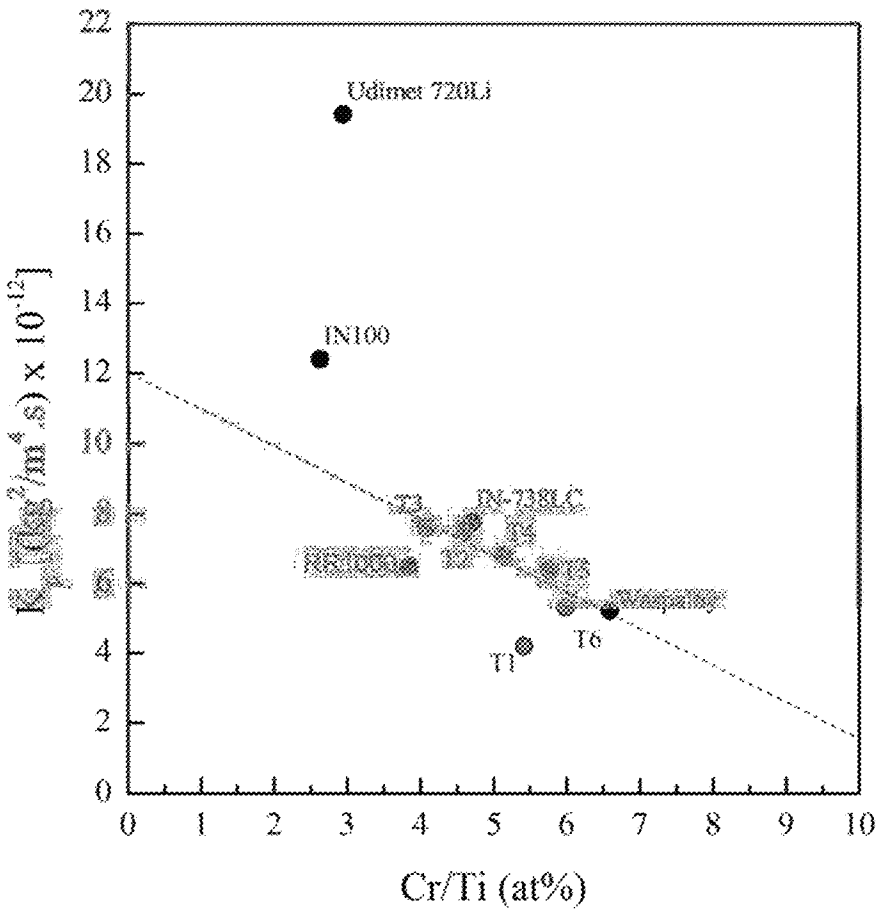
FIG. 7 is a scatter graph showing correlation between Cr/Ti ratio (in atomic percent) and the oxidation resistance for a number of chromia forming alloys, including the alloys described in Table 5 which were used to determine optimal alloy chemistry for oxidation resistance for the present invention.

The experimental alloys T1-T6 described in Table 4 allowed for a systematic study of compositional-property relationships for oxidation resistance. The results for these alloys—combined with the other industrial alloys studied—provided experimental evidence of a strong correlation between oxidation resistance and the Cr/Ti ratio in atomic percent in the alloy, as demonstrated by FIG. 7. The effect of Cr/Ti ratio on oxidation resistance is particularly evident in alloys T4, T5 and T6. In these alloys, in which only the Ti level was modified for a fixed Cr level, it was found that Nb could be substituted for Ti additions on a 1:1 ratio with no loss in performance whilst improving oxidation resistance. It was concluded on the basis of these experiments that an alloy with a Cr/Ti ratio greater than 4 was preferred, allowing for oxidation resistance better than the current state of the art. Additions of up to 0.7 at % were considered, as this has been found to improve oxidation resistance.

The alloys described herein are suitable for powder metallurgy processing. Consequently, carbon is added to the alloy compositions to pin grain boundaries for grain growth control and to inhibit grain boundary sliding during high temperature deformation during powder metallurgy processing, and particularly during heat treatment. The main grain boundary strength in the described alloys is provided by boron and zirconium through formation of oxides and borides. The preferred ranges for carbon, boron and zirconium are listed in Table 2.

The limiting factor when aiming to maximise the (Ti+Ta+Nb)/Al is microstructural stability. Phase equilibrium calculations show a correlation between increasing (Ti+Ta+Nb)/Al and the propensity to form deleterious phases such as η ($Ni_3Ti$) or δ ($Ni_3Nb$) the upper limit for the (Ti+Ta+Nb)/Al ratio was found to be 1.1. If the upper limit for the (Ti+Ta+Nb)/Al ratio is applied, the concentration of Al in the alloy must be greater than or equal to 6 at % to achieve a yield strength of at least 1000 MPa at 800° C.

The alloy may also comprise small amounts of hafnium in amounts up to 0.2 at %, (corresponding to up to 0.5 wt %). Preferably, the composition contains less than 0.1 at % hafnium (corresponding to up to 0.25 wt %). Hafnium in these quantities has been found to improve dwell crack growth resistance, thereby increasing component life of a component made of the alloy.

The described alloy compositions can be produced using powder metallurgy methods. Powder metallurgy methods are particularly suitable for the production of the composition where the alloy is to be used for the formation of gas turbine rotor discs.

In a preferred process, small powder particles (<53 μm in size) produced by, for example, inert gas atomisation, are consolidated in a stainless steel container using hot isostatic pressing to form a sintered article. The sintered article is then extruded to produce a fine grain size billet. Increments are then cut from these billets and forged, preferably, at low strain rates under isothermal conditions. The forging temperature and strain rates are chosen to achieve a required average grain size. In a preferred embodiment, the required average grain size for forming gas turbine rotor discs is ASTM 7 to 6 (32-45 μm). In some cases, the grain size may be as large as ASTM 1 (180 μm).

Other billet and forging technology could alternatively be used to produce raw material for disc rotors. The applicability of alternative techniques, such as cast and wrought processing, i.e. conversion of triple melted ingot, and conventional press forging would depend on the level of success in achieving (i) a consistently homogeneous ingot chemistry with acceptable amounts of melt anomalies, (ii) a sufficiently large forging window and crack-free forgings, and (iii) control of grain growth to produce a narrow grain size distribution in heat treated forgings.

To generate a forging having the required balance of properties, it is necessary to subject the forging to a heat treatment process. This process comprises the following process steps, conducted in the following order:

1. Solution heat treating the forging above the γ' solvus temperature for a sufficient duration to grow the grain size to the required average grain size of ASTM 7 to 6 (32-45 μm) throughout. The required time for a given alloy composition and initial powder size could be determined by trial and error, and determined by microscopy of samples of the resulting heat treated forging. If higher levels of yield stress at all temperatures and low cycle fatigue performance below 650° C. are required in the bore and diaphragm regions 44 of the disc rotor 40, then a dual microstructure solution heat treatment can be applied to forgings to produce a fine (5-10 μm) average grain size in these regions.
2. Quenching the forging from the solution heat treatment temperature to room temperature using forced/fan air cooling, polymer or oil quenching.
3. Undertaking stabilisation/stress relief and precipitation heat treatments of the forging at a temperature of between 830° C. and 870° C. for 4-16 hours, followed by air cooling. This heat treatment is required to (a) relieve residual stresses from quenching and (b) grow tertiary γ' particles.

It is thought that the high temperature stabilisation/stress relief heat treatment will promote reduced rates of crack growth from dwell cycles by precipitating limited amounts of $M_{23}C_6$ carbides at grain boundaries and by increasing the range of tertiary γ' particles, which will reduce the local creep strain resistance at the crack tip. The heat treatment will also dissolve some tertiary γ'. This will precipitate into smaller tertiary γ' particles during the lower temperature precipitation heat treatment, particularly in intra-granular locations, which will improve the resistance to primary creep and creep damage such as slip and grain boundary sliding.

Once the heat treatment process has been conducted, the disc rotor 40 can be formed from the heat treated billet/forging. Due in particular to the relatively low γ' solvus temperature of the forged alloy, the disc rotor 40 can be formed using conventional forging/machining methods.

The following examples are illustrative of several aspects of the disclosure:

EXAMPLE ALLOY D1

Alloy D1 represents a baseline composition for the alloy described within this disclosure. The alloy consists essentially of, in weight percent, 13.3 to 13.9% chromium, 16.2 to 16.8% cobalt, 2.9 to 3.5% tungsten, 3.1 to 3.5% aluminium, 2.9 to 3.3% titanium, 1.4 to 1.8% tantalum, 1.9 to 2.3% niobium, 0.01 to 0.05% carbon, 0.01 to 0.04% boron, 0.05 to 0.07% zirconium, with the balance being nickel and incidental impurities.

Alloy D1 has been designed with an equal weighting considered for all material properties. The sum of γ' forming elements (Al+Ti+Ta+Nb) equal to 12.5 at % producing an alloy with 54% volume fraction of γ', the ratio of (Ti+Ta+Nb)/Al is 0.79. The alloy has at least a 14% improvement in specific yield strength when compared to RR1000 in a coarse grained microstructure at all temperatures. The sum of Co+Cr+Mo+W is equal to 32 at % for creep resistance. The Cr level is 15 at % with the ratio of Cr/Ti in atomic percent fixed at 4 to attain an adequate level of oxidation resistance.

Alongside alloy D1, further alloys were developed. For these further alloys, a bias toward specific properties was considered. The alloys described in the following section will be described in comparison to alloy D1.

EXAMPLE ALLOY D2

Alloy D2 has been designed with a bias toward low density and increased oxidation resistance. The alloy consists essentially of, in weight percent, 14.4 to 15% chromium, 14.3 to 14.9% cobalt, 2.3 to 2.9% tungsten, 3.6 to 4.0% aluminium, 3.2 to 3.6% titanium, 1.4 to 1.8% tantalum, 1.4 to 1.8% niobium, 0.01 to 0.05% carbon, 0.01 to 0.04% boron, 0.05 to 0.07% zirconium, with the balance being nickel and incidental impurities.

The improved oxidation resistance was achieved by increasing the Cr level and Cr/Ti ratio in the alloy. This oxidation resistance was improved at the expense of creep resistance with levels of Co and W being reduced to maintain microstructural stability. Lower density alloys are desirable for aerospace applications; density was reduced by decreasing the W content and increasing the Al content. The reduction in APB energy due to a lower (Ti+Ta+Nb)/Al ratio to 0.69 was offset by an increase in Al+Ti+Nb+Ta equal to 13.5 at %, increasing the γ' volume fraction to 56% to maintain a desirable specific yield strength.

EXAMPLE ALLOY D3

Alloy D3 has been designed with a bias towards creep resistance. The alloy consists essentially of, in weight percent, 10.4 to 11.0% chromium, 16.9 to 17.5% cobalt, 4.3 to 5.0% tungsten, 3.5 to 3.9% aluminium, 3.1 to 3.5% titanium, 2.9 to 3.3% tantalum, 1.4 to 1.8% niobium, 0.01 to 0.05% carbon, 0.01 to 0.04% boron, 0.05 to 0.07% zirconium, the balance being nickel and incidental impurities.

The improvements in creep resistance have been achieved by increasing the level of W and Co in the alloy. The increase in creep resistance has been achieved at the expense of oxidation resistance and density. The Cr content and the Cr/Ti ratio have been reduced, Cr was reduced in order to maintain alloy stability. Higher levels of γ' have also been utilised in order to improve creep strength, the γ' level has been increased by using additions of Al in order to offset the increases in density attained from high levels of W. This alloy has improved mechanical properties at the expense of environmental resistance.

EXAMPLE ALLOY D4

Alloy D4 has been designed for superior strength combined with increased oxidation resistance, achieved at the expense of reduced creep resistance and increased density. The alloy consists essentially of, in weight percent, 14.1 to 14.5% chromium, 15.9 to 16.5% cobalt, 2.2 to 2.8% tungsten, 2.6 to 3.0% aluminium, 2.3 to 2.7% titanium, 2.9 to 3.3% tantalum, 3.0 to 3.4% niobium, 0.01 to 0.05% carbon, 0.01 to 0.04% boron, 0.05 to 0.07% zirconium, the balance being nickel and incidental impurities.

Increased Nb levels have been used to provide mechanical strength. This alloy has a high Cr content and Cr/Ti level for exceptional environmental resistance. Reducing the W content was necessary in order to control alloy density and stability. The γ' volume fraction has been reduced, Al+Ti+Nb+Ta equal to 12 at %, and the (Ti+Ta+Nb)/Al ratio has been increase to 1. This produces a high strength alloy with a low γ' volume fraction of 48%, allowing for high Cr levels maximising oxidation resistance.

EXAMPLE ALLOY D5

Alloy D5 has been designed for low cost and reduced density; this is at the expense of oxidation resistance. The consists essentially of, in weight percent, 14.3 to 14.9% chromium, 14.2 to 14.8% cobalt, 2.9 to 3.5% tungsten, 2.6 to 3.0% aluminium, 4.4 to 4.8% titanium, 1.4 to 1.8% tantalum, 0.6 to 1.0% niobium, 0.01 to 0.05% carbon, 0.01 to 0.04% boron, 0.05 to 0.07% zirconium, and wherein the balance comprises nickel and incidental impurities.

By substituting Nb with additions of Ti it was possible to reduce the density of the alloy. The Cr level has been increased to try and maintain a suitably high Cr/Ti ratio. The sum of Al+Ti+Ta+Nb was set at 12.4 at % to produce a γ' volume fraction of 52%. The APB energy was increased by producing an alloy where the (Ti+Ta+Nb)/Al ratio is 1.06 meaning that a high specific strength is attained. The use of low Ta concentrations combined with the low Nb levels creates a low cost alloy.

EXAMPLE ALLOY D6

Alloy D6 has been designed for superior creep resistance. The consists essentially of, in weight percent, 12.1 to 12.7% chromium, 13.8 to 14.4% cobalt, 4.1 to 4.7% tungsten, 3.2 to 3.6% aluminium, 2.5 to 2.9% titanium, 3.5 to 3.9% tantalum, 1.2 to 1.6% niobium, 1.1 to 1.5% molybdenum, 0.01 to 0.05% carbon, 0.01 to 0.04% boron, 0.05 to 0.07% zirconium, and wherein the balance comprises nickel and incidental impurities.

High levels of Ta have been used in substitution for Ti additions. This results a high strength alloy with a high Cr/Ti ratio, allowing for superior oxidation resistance in a relatively low Cr alloy. Small levels of Mo have been utilised to maximise creep resistance whilst maintaining a microstructurally stable alloy.

EXAMPLE ALLOY D7

Alloy D7 has been designed for superior creep resistance and high specific strength. The alloy consists essentially of, in weight percent, 13.1 to 13.7% chromium, 13.7 to 14.3% cobalt, 5.0 to 5.3% tungsten, 3.0 to 3.4% aluminium, 2.9 to 3.3% titanium, 3.5 to 3.9% tantalum, 1.4 to 1.8% niobium, 1.1 to 1.5% molybdenum, 0.01 to 0.05% carbon, 0.01 to 0.04% boron, 0.05 to 0.07% zirconium, and wherein the balance comprises nickel and incidental impurities.

The levels of W and Mo are significantly increased in order to impart superior creep resistance. The Cr/Ti in the alloy is maintained in order to retain oxidation resistance. The sum of Al+Ti+Ta+Nb is set at 13.1 at % to produce a γ' volume fraction of 55%. The APB energy is increased by producing an alloy where the (Ti+Ta+Nb)/Al ratio is 0.85 allowing a high specific strength to be attained. Cobalt levels have been lowered in order to maintain microstructural stability.

EXAMPLE ALLOY D8

Alloy D8 has been designed for superior creep resistance, high specific strength and improved oxidation resistance at the expense of increased material cost. The alloy consists essentially of, in weight percent, 13.0 to 13.6% chromium, 13.6 to 14.2% cobalt, 5.0 to 5.3% tungsten, 3.0 to 3.4% aluminium, 2.6 to 3.0% titanium, 4.5 to 4.8% tantalum, 1.3 to 1.7% niobium, 1.1 to 1.5% molybdenum, 0.7 to 1% iron, 0.01 to 0.05% carbon, 0.01 to 0.04% boron, 0.05 to 0.07% zirconium, and wherein the balance comprises nickel and incidental impurities.

The levels of W and Mo are significantly increased in order to impart superior creep resistance. The Cr/Ti is increased to 4.3 to improve oxidation resistance. The sum of Al+Ti+Ta+Nb is set at 13.1 at % to produce a γ' volume fraction of 55%. The APB energy is increased by producing an alloy where the (Ti+Ta+Nb)/Al ratio is 0.85 resulting in a high specific strength. The maximum levels of Tantalum have been used to attain high specific strength as this element has the strongest effect on APB energy. Cobalt levels have been lowered in order to maintain microstructural stability. Additions of iron have been included.

EXAMPLE ALLOY D9

Alloy D9 has been designed for superior creep resistance, high specific strength and improved oxidation resistance at the expense of increased material cost. The alloy consists essentially of, in weight percent, 12.1 to 12.7 chromium, 14.8 to 15.4 cobalt, 2.9 to 3.3% tungsten, 3.0 to 3.4% aluminium, 2.7 to 3.1% titanium, 4.8 to 5.0% tantalum, 1.2 to 1.6% niobium, 1.9 to 2.3% molybdenum, 0.7 to 1% iron, 0.01 to 0.05% carbon, 0.01 to 0.04% boron, 0.05 to 0.07% zirconium, 0.4 to 0.5% silicon and 0.5 to 0.6 manganese wherein the balance comprises nickel and incidental impurities.

The levels of W and Mo are significantly increased in order to impart superior creep resistance. Additions of Mn have been incorporated to impart improved oxidation resistance. The sum of Al+Ti+Ta+Nb is set at 13.0 at % to produce a γ' volume fraction of 54%. Additions of Si have been made to lower γ' solvus temperature. The APB energy is increased by producing an alloy where the (Ti+Ta+Nb)/Al ratio is 0.86 resulting in a high specific strength. The maximum levels of Tantalum have been used to attain high specific strength as this element has the strongest effect on APB energy. Cobalt levels have been lowered in order to maintain improved microstructural stability. Additions of iron have been included.

EXAMPLE ALLOY D10

Alloy D10 has been designed for superior creep resistance, high specific strength and improved oxidation resistance at the expense of increased material cost. The alloy consists essentially of, in weight percent, 12.1 to 12.7% chromium, 16.2 to 16.8% cobalt, 3.2 to 3.6% tungsten, 3.0 to 3.4% aluminium, 2.6 to 3.0% titanium, 4.8 to 5.0% tantalum, 1.2 to 1.6% niobium, 2.1 to 2.3% molybdenum, 0.7 to 1% iron, 0.01 to 0.05% carbon, 0.01 to 0.04% boron, 0.05 to 0.09% zirconium, 0.15 to 0.35% silicon and 0.5 to 0.6 manganese and wherein the balance comprises nickel and incidental impurities.

The levels of W and Mo are significantly increased in order to impart superior creep resistance. Additions of Mn have been incorporated to impart improved oxidation resistance. The sum of Al+Ti+Ta+Nb is set at 13.0 at % to produce a γ' volume fraction of 53%. Additions of Si have been made to lower γ' solvus temperature. The APB energy is increased by producing an alloy where the (Ti+Ta+Nb)/Al ratio is 0.86 resulting in a high specific strength. The maximum levels of Tantalum have been used to attain high specific strength as this element has the strongest effect on APB energy. Cobalt levels have increased to improve creep properties and processing of the alloy whilst maintaining an tolerable level of microstructural stability.

The alloy composition and forging/heat treatment methods described above provide an alloy composition suitable for forming rotor discs of gas turbine engines having a number of advantages of prior alloy compositions.

The described alloys compositions, once heat treated, show a balance of material properties that will enable them to be used to form gas turbine rotor discs capable of operation at temperatures up to 800° C. for prolonged periods. Whilst improvements in strength and resistance to creep strain accumulation are expected from these alloys, the major benefit is considered to be in the resistance to hot corrosion and oxidation damage and dwell crack growth, as well as dwell fatigue endurance.

Figure 8:
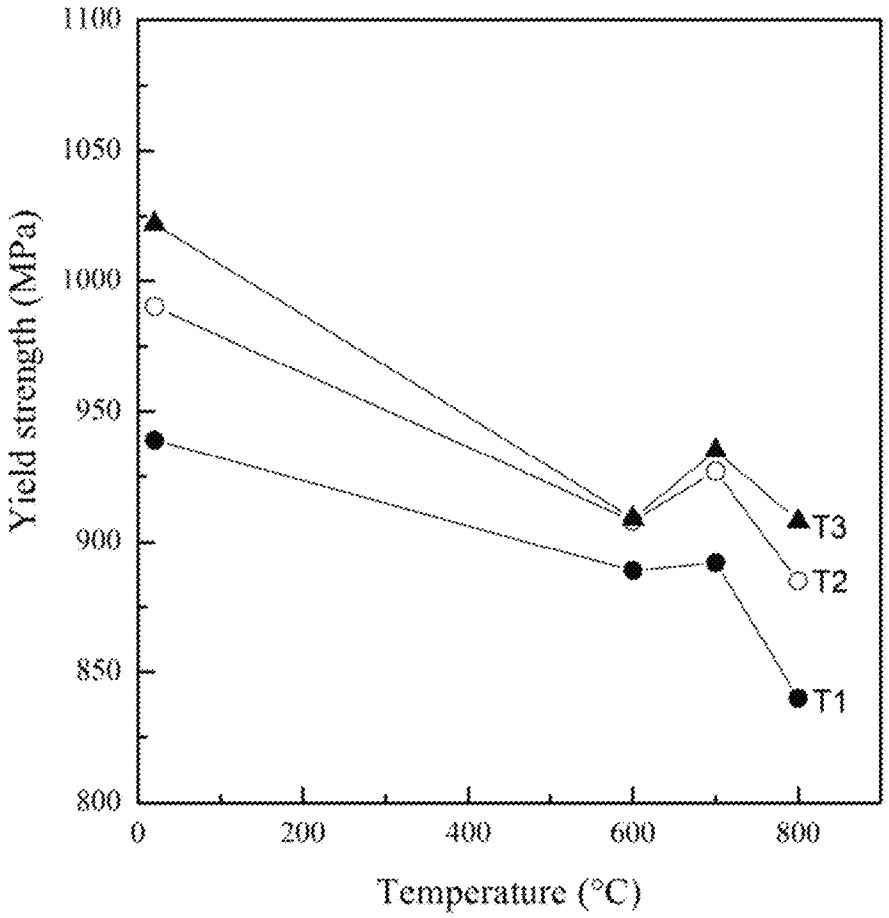
FIG. 8 is a graph showing the yield strength at various temperatures for alloys T1-T3 which are described in Table 4.

FIG. 8 shows the yield strength for example alloys T1, T2 and T3 at various temperatures. As can be seen, each of the alloys maintains yield strengths greater than 825 MPa at temperatures up to 800° C., with alloy T3 having a yield strength greater than 900 MPa at 800° C. This demonstrates how increased volume fractions of γ', can increase the yield strength at high temperatures in comparison to the prior art. The alloys T1-T3 had (Ti+Ta+Nb)/Al ratios of 0.55 producing alloys with low APB energy. The increase in APB energy—attained by having a (Ti+Ta+Nb)/Al ratio of at least 0.6—enables a yield strength of 1000 MPa at temperatures of 800° C. when the volume fraction of γ' is greater than 50%.

Figure 5:
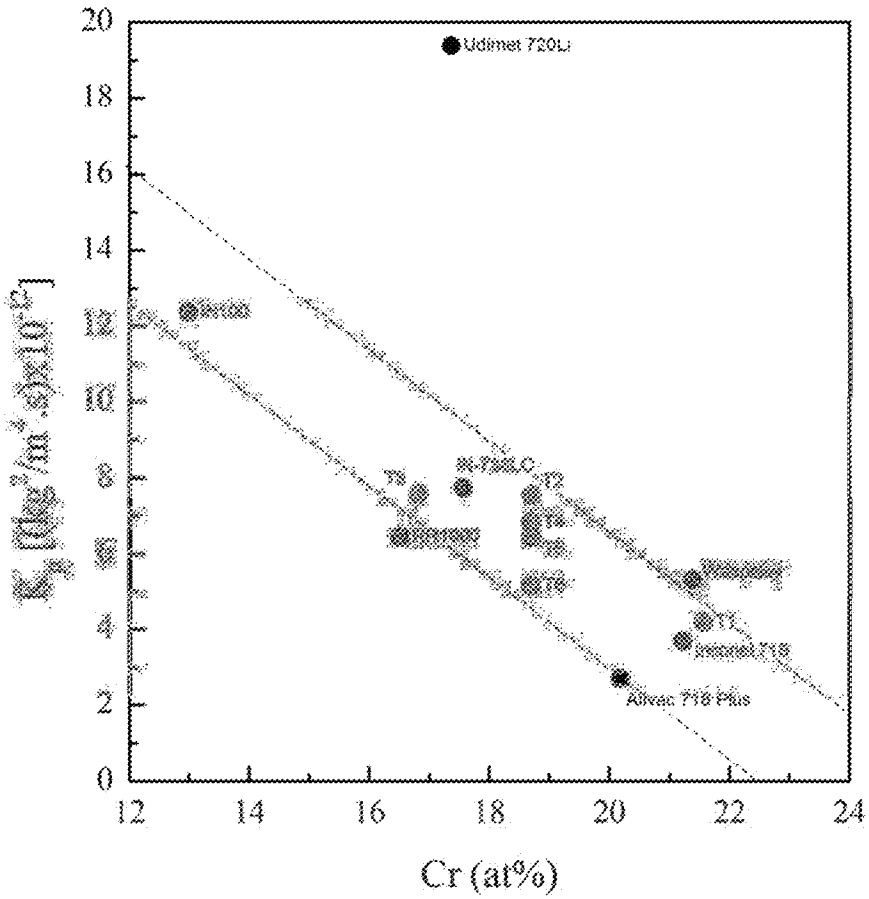
FIG. 5 is a scatter graph showing the correlation between Cr content (in atomic percent) and oxidation resistance for a number of chromia forming alloys, including the alloys described in Table 4 which were used to determine optimal alloy chemistry for oxidation resistance for the present invention.

FIG. 5 shows experimental results after 100 hours of cyclic oxidation testing at 800° C. (5 cycles in total) showing the effect of Cr content (at %) on the oxidation resistance of a number of chromia forming disc alloys. As can be seen, example alloys T1 to T6 have a high oxidation resistance. The Cr and Ti levels have been optimised for alloys D1-D8 to ensure that these levels of oxidation resistance are achieved.

Unlike the prior art, it is proposed that the disclosed alloys achieve a balance between resistance to environmental degradation and high temperature properties such as proof strength, resistance to creep strain accumulation, dwell fatigue and damage tolerance. Use of components made from the prior art alloys is limited to temperatures between 700-750° C., whereas the disclosed alloys can be used to increase the operating temperatures of the rotor discs of a gas turbine engine up to 800° C.

Although the description refers to the described alloys as being particularly useful for forming rotor discs for gas turbine, the alloys could also be used to form other components. For example, the alloys could be used for hot static parts of a gas turbine engine, such as combustor and turbine casings. These applications would benefit from all of the envisaged improvements in material properties, notably the improved high temperature proof strength and resistance to creep strain accumulation. As compressor discharge temperatures and turbine entry temperatures are progressively raised to produce improvements in thermal efficiency and thus fuel consumption, the temperature of static parts in the combustor and turbine also increase during operation. Such casings could be produced using conventional cast and wrought technology, i.e. from forgings, or via powder metallurgy, though the consolidation of inert gas atomised powder using hot isostatic pressure. The latter route is preferred given the highly alloyed compositions and ability to produce compacts that are close to the component geometry, which reduces the amount of material required and the time required to machine the component.

Although the alloy is described as being formed by powder metallurgy and subjected by heat treatment, other material processing methods could be used to generate articles from the alloy compositions having the required properties.

The invention claimed is:

1. An alloy composition comprising, in atomic percent, between 12 and 17.3% chromium, between 13.7 and 18.3% cobalt, between 0.8 and 1.8% tungsten, between 5.8 and 8.2% aluminium, between 2.7 and 6.2% titanium, between 0.4 and 1.7% tantalum, up to 2.1% niobium, between 0.05 and 0.3% carbon, between 0.05% and 0.25% boron, between 0.02 and 0.06 zirconium, up to 1.5% molybdenum, up to 0.2% hafnium, up to 4% iron, up to 1% silicon and up to 0.65% manganese, the balance being nickel save for incidental impurities; wherein the alloy has a γ' fraction of between about 50% and about 60%.

2. An alloy composition according to claim 1 comprising, in atomic percent, substantially 15% chromium, substantially 16% cobalt, substantially 7% aluminium, substantially 3.7% titanium, substantially 0.5% tantalum, substantially 1% tungsten, substantially 1.3% niobium, substantially 0.08% boron, substantially 0.13% carbon, substantially 0.04% zirconium, the balance being nickel save for incidental impurities.

3. An alloy composition according to claim 1 comprising, in atomic percent, substantially 16% chromium, substantially 14% cobalt, substantially 8% aluminium, substantially 3.7% titanium, substantially 0.5% tantalum, substantially 0.8% tungsten, substantially 1.3% niobium, substantially 0.08% boron, substantially 0.13% carbon, substantially 0.04% zirconium, the balance being nickel save for incidental impurities.

4. An alloy composition according to claim 1 comprising, in atomic percent, substantially 12% chromium, substantially 17% cobalt, substantially 8% aluminium, substantially 4% titanium, substantially 1% tantalum, substantially 1.5% tungsten, substantially 1% niobium, substantially 0.08% boron, substantially 0.13% carbon, substantially 0.04% zirconium, the balance being nickel save for incidental impurities.

5. An alloy composition according to claim 1 comprising, in atomic percent, substantially 16% chromium, substantially 16% cobalt, substantially 6% aluminium, substantially 3% titanium, substantially 1% tantalum, substantially 0.8% tungsten, substantially 2% niobium, substantially 0.08% boron, substantially 0.13% carbon, substantially 0.04% zirconium, the balance being nickel save for incidental impurities.

6. An alloy composition according to claim 1 comprising, in atomic percent, substantially 16% chromium, substantially 14% cobalt, substantially 6% aluminium, substantially 5.5% titanium, substantially 0.5% tantalum, substantially 1% tungsten, substantially 0.5% niobium, substantially 0.08% boron, substantially 0.13% carbon, substantially 0.04% zirconium, the balance being nickel save for incidental impurities.

7. An alloy composition according to claim 1 comprising, in atomic percent, substantially 14% chromium, substantially 14% cobalt, substantially 7.4% aluminium, substantially 3.25% titanium, substantially 1.2% tantalum, substantially 0.85% molybdenum, substantially 1.4% tungsten, substantially 0.9% niobium, substantially 0.135% boron, substantially 0.245% carbon, substantially 0.036% zirconium, the balance being nickel save for incidental impurities.

8. An alloy composition according to claim 1 comprising, in atomic percent, substantially 15.2% chromium, substantially 14% cobalt, substantially 7.1% aluminium, substantially 3.8% titanium, substantially 1.2% tantalum, substantially 0.8% molybdenum, substantially 1.7% tungsten, substantially 1.0% niobium, substantially 0.135% boron, substantially 0.245% carbon, substantially 0.036% zirconium, the balance being nickel save for incidental impurities.

9. An alloy composition according to claim 1 having an $Md_\gamma$ value less than 0.88, where $$Md_\gamma = \sum_{i=1}^{n} x_i (Md)_i$$

and where $x_i$ is the atomic fraction of element i in the gamma matrix; $Md_i$ is the parameter representing an average energy level of d orbitals of the alloying element i; and n is the number of elements in the gamma matrix.

10. A rotor disk for a gas turbine engine formed of an alloy according to claim 1.

11. An alloy composition according to claim 1 consisting essentially of, in atomic percent, between 12 and 17.3% chromium, between 13.7 and 18.3% cobalt, between 0.8 and 1.8% tungsten, between 5.8 and 8.2% aluminium, between 2.7 and 6.2% titanium, between 0.4 and 1.7% tantalum, up to 2.1% niobium, between 0.05 and 0.3% carbon, between 0.05% and 0.25% boron, between 0.02 and 0.06 zirconium, up to 1.5% molybdenum, up to 0.2% hafnium, up to 4% iron, up to 1% silicon and up to 0.65% manganese, the balance being nickel save for incidental impurities;

wherein a (Ti+Ta+Nb)/Al ratio is between 0.6 and 1.1.

12. An alloy composition comprising, in atomic percent, substantially 15.2% chromium, substantially 14% cobalt, substantially 7.1% aluminium, substantially 3.5% titanium, substantially 1.6% tantalum, substantially 0.8% molybdenum, substantially 1.7% tungsten, substantially 1.0% niobium, substantially 0.135% boron, substantially 0.245% carbon, substantially 0.036% zirconium, substantially 1.0% iron, the balance being nickel save for incidental impurities.

13. An alloy composition comprising, in atomic percent, substantially 14.0% chromium, substantially 15.0% cobalt, substantially 7.0% aluminium, substantially 3.5% titanium, substantially 1.6% tantalum, substantially 1.3% molybdenum, substantially 1.0% tungsten, substantially 0.9% niobium, substantially 0.136% boron, substantially 0.147% carbon, substantially 0.036% zirconium, substantially 1.0% iron, substantially 0.94% silicon, substantially 0.59% manganese the balance being nickel save for incidental impurities.

14. An alloy composition comprising, in atomic percent, substantially 14.1% chromium, substantially 16.5% cobalt, substantially 7.0% aluminium, substantially 3.5% titanium, substantially 1.6% tantalum, substantially 1.4% molybdenum, substantially 1.1% tungsten, substantially 0.9% niobium, substantially 0.109% boron, substantially 0.147% carbon, substantially 0.058% zirconium, substantially 1.0% iron, substantially 0.53% silicon, substantially 0.59% manganese the balance being nickel save for incidental impurities.

* * * * *